US011767847B2

(12) United States Patent
Colman et al.

(10) Patent No.: US 11,767,847 B2
(45) Date of Patent: Sep. 26, 2023

(54) COMPRESSOR OR VACUUM PUMP DEVICE, A LIQUID RETURN SYSTEM FOR SUCH A COMPRESSOR OR VACUUM PUMP DEVICE AND A METHOD FOR DRAINING LIQUID FROM A GEARBOX OF SUCH A COMPRESSOR OR VACUUM PUMP DEVICE

(71) Applicant: ATLAS COPCO AIRPOWER, NAAMLOZE VENNOOTSCHAP, Wilrijk (BE)

(72) Inventors: Luc Colman, Wilrijk (BE); Dimi De Jonghe, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 94 days.

(21) Appl. No.: 17/431,640

(22) PCT Filed: Mar. 23, 2020

(86) PCT No.: PCT/IB2020/052669

§ 371 (c)(1),
(2) Date: Aug. 17, 2021

(87) PCT Pub. No.: WO2020/217110

PCT Pub. Date: Oct. 29, 2020

(65) Prior Publication Data

US 2022/0112905 A1 Apr. 14, 2022

Related U.S. Application Data

(60) Provisional application No. 62/837,255, filed on Apr. 23, 2019.

(30) Foreign Application Priority Data

Jul. 2, 2019 (BE) ..... 2019/5424

(51) Int. Cl.
*F04C 29/04* (2006.01)
*F04F 5/24* (2006.01)
(Continued)

(52) U.S. Cl.
CPC ..... *F04C 29/042* (2013.01); *F04C 27/02* (2013.01); *F04C 29/0007* (2013.01);
(Continued)

(58) Field of Classification Search
CPC ..... F04F 5/24; F04C 29/026; F04C 29/042; F04C 29/0007; F04C 29/0014;
(Continued)

(56) References Cited

U.S. PATENT DOCUMENTS 2,961,151 A 11/1960 Fobian
3,973,879 A * 8/1976 Ramm ..... F04C 19/004 417/69
(Continued)

FOREIGN PATENT DOCUMENTS

CN 202756317 U 2/2013
CN 203023148 U 6/2013
(Continued)

OTHER PUBLICATIONS

Written opinion for PCT/IB2020/052669 dated Jun. 9, 2020.
International search report for PCT/IB2020/052669 dated Jun. 9, 2020.

*Primary Examiner* — Bryan M Lettman
(74) *Attorney, Agent, or Firm* — Sughrue Mion, PLLC

(57) ABSTRACT

A liquid-injected compressor or vacuum pump device with a liquid-injected compressor or vacuum pump element (2), which includes a liquid return system (7), a motor (4) to drive the compressor or vacuum pumping element (2), a gearbox (3) provided between the motor (4) and the liquid-injected compressor or vacuum pump element (2), and a
(Continued)

liquid separator vessel (5) in fluid connection with an outlet (6) of the compressor or vacuum pump element (2). The liquid return system (7) includes a main body (8) with a chamber in which a first compressed gas flow (11) from the liquid separator vessel (5) and a second fluid flow (15) from the gearbox (3) are mixed together to form a third fluid flow (20). The third fluid flow (20) leaves the chamber via an outlet (16) and is directed into the liquid-injected compressor or vacuum pump element (2) via the injection point (17).

25 Claims, 2 Drawing Sheets

(51) Int. Cl.
*F04C 29/02* (2006.01)
*F04C 29/00* (2006.01)
*F04C 27/02* (2006.01)

(52) U.S. Cl.
CPC ..... *F04C 29/021* (2013.01); *F04C 29/026* (2013.01); *F04C 29/028* (2013.01); *F04F 5/24* (2013.01)

(58) Field of Classification Search
CPC ..... F04C 27/02; F04C 29/021; F04C 29/029; F04C 29/028; F04C 29/02
USPC ..... 417/76–84, 151–198
See application file for complete search history.

(56) References Cited

U.S. PATENT DOCUMENTS

| | | | | |
|---|---|---|---|---|
| RE30,499 | E * | 2/1981 | Moody, Jr. ..... | F04C 29/0014 62/505 |
| 2003/0156939 | A1* | 8/2003 | Evans ..... | F04B 39/16 415/26 |
| 2013/0089413 | A1 | 4/2013 | Fujimoto et al. | |
| 2017/0176055 | A1* | 6/2017 | Seitz ..... | F25B 1/00 |
| 2018/0017061 | A1 | 1/2018 | Able et al. | |
| 2018/0112902 | A1 | 4/2018 | Pham | |

FOREIGN PATENT DOCUMENTS

| | | | |
|---|---|---|---|
| CN | 207333318 | U | 5/2018 |
| DE | 202015102623 | U1 | 6/2015 |
| GB | 1512332 | * | 6/1978 |
| JP | 2013-83371 | A | 5/2013 |
| NL | 7604912 | A | 11/1976 |
| TW | 201202555 | A | 1/2012 |
| TW | 201719022 | A | 6/2017 |
| TW | 201816272 | A | 5/2018 |

* cited by examiner

COMPRESSOR OR VACUUM PUMP DEVICE, A LIQUID RETURN SYSTEM FOR SUCH A COMPRESSOR OR VACUUM PUMP DEVICE AND A METHOD FOR DRAINING LIQUID FROM A GEARBOX OF SUCH A COMPRESSOR OR VACUUM PUMP DEVICE

CROSS-REFERENCE TO RELATED APPLICATIONS

This application is a National Stage of International Application No. PCT/IB2020/052669 filed Mar. 23, 2020, which claims priority under U.S.C. § 119(a) to U.S. provisional application 62/837,255 filed Apr. 23, 2019 and Belgium Patent Application No. 2019/5424 filed on Jul. 2, 2019.

BACKGROUND OF THE INVENTION

Field of the Invention

The present invention relates to a compressor or vacuum pump device with a liquid-injected compressor or vacuum pump element, a liquid return system for such compressor or vacuum pump device, and a method for draining liquid from a gearbox of such a compressor or vacuum pump device.

More specifically, the present invention relates to a compressor or vacuum pump device with a liquid return system comprising a main body with multiple inlets and an outlet, wherein one of the inlets is in fluid connection with the gearbox.

Background

In prior art, compressor or vacuum pump devices are known with a liquid-injected compressor or vacuum pump element, wherein the liquid-injected compressor or vacuum pump element is driven via a shaft.

Here this shaft can be driven via a gearbox, which gearbox in turn is driven by a drive shaft which is driven by a motor.

The liquid being injected, for instance oil, is used for lubrication, cooling, sealing and/or corrosion protection of moving parts in the compressor or vacuum pump element.

To prevent leaking between the compressor or vacuum pump element on the one hand and the motor on the other hand, the compressor or vacuum pump element and gearbox are liquid-tight separated from each other by means of a first seal on the shaft driving the compressor or vacuum pump element on the one hand and, on the other hand, the motor and gearbox are liquid-tight separated from each other by means of a second seal on the drive shaft driving the gearbox.

However, said seals are prone to be susceptible to failure resulting in liquid leaking into the gearbox, especially in motors with a speed-controlled drive at high speeds.

Consequently, if the seals fail, liquid will accumulate in the gearbox, causing the compressor or vacuum pump device to require shutting down for maintenance to remove this accumulated liquid from the gearbox, which may result in extended downtimes.

In addition, in components of the compressor or vacuum pump device from which liquid has leaked into the gearbox, this liquid must be replenished during this maintenance, which further increases the downtime of the compressor or vacuum pump device.

Moreover, in classic compressor or vacuum pump devices, seal failure is not immediately visually detectable as the gearbox traditionally comprises a sealed and opaque housing, so the need for maintenance cannot be determined on the basis of such direct visual detection.

The seals can only be inspected visually by shutting down the compressor or vacuum pump device and disassembling the compressor or vacuum pump device in such a way that the seals are exposed to an observer.

Even when the compressor or vacuum pump device are disassembled and the seals are exposed, it may be difficult or impossible to detect a possible seal failure during operation of the compressor or vacuum pump device if, for example, this failure only occurs when the compressor or vacuum pump device is in operation.

Sensors exist for detecting leaks in a compressor or vacuum pump device which can be built into the compressor or vacuum pump device housing in an integrated way.

However, these types of sensors may have a complex structure, may be difficult to replace and/or maintain due to their internal integration in the compressor or vacuum pump device, and fundamentally do not provide a solution to prevent and/or even remedy the leakage and failure of seals in the compressor or vacuum pump device.

As a result, the compressor or vacuum pump device must be shut down in the event of seal failure to prevent and/or remedy liquid accumulation in the gearbox.

Systems to prevent and/or remedy this accumulation of liquid in the gearbox often comprise multiple parts that are difficult to maintain and/or to replace when integrated into the compressor or vacuum pump device.

The present invention aims at offering a solution to one or more of said and/or other disadvantages.

SUMMARY OF THE INVENTION

For this purpose, the invention relates to a compressor or vacuum pump device with a liquid-injected compressor or vacuum pump element, which compressor or vacuum pump device further comprises a liquid return system, a motor to drive the liquid-injected compressor or vacuum pump element, a gearbox provided between the motor and the liquid-injected compressor or vacuum pump element, and a liquid separator vessel in fluid connection with an outlet of the liquid-injected compressor or vacuum pump element, wherein the liquid return system comprises a main body with a chamber provided with an outlet and a first inlet, wherein the first inlet is in fluid connection with the liquid separator vessel and receives a first compressed gas flow from the liquid separator vessel, and wherein the outlet is in fluid connection with an injection point of the liquid-injected compressor or vacuum pump element, characterized in that the chamber is further provided with a second inlet that is in fluid connection with the gearbox and receives a second fluid flow from the gearbox, wherein the chamber is configured to mix the aforementioned first compressed gas flow and a second fluid flow together into a third fluid flow, which third fluid flow leaves the chamber via the outlet and is directed via the injection point into the liquid-injected compressor or vacuum pump element.

An advantage of the compressor or vacuum pump device according to the invention is that liquid that accumulates in the gearbox in the event of seal failure can be discharged to the second inlet of the chamber of the main body of the liquid return system.

The discharged liquid can then form a mixture in the chamber with the incoming first compressed gas flow coming from the liquid separator vessel and entering the chamber through the first inlet, after which this mixture can be directed via the chamber outlet to the injection point of the liquid-injected compressor or vacuum pump element.

This way, liquid that has leaked into the gearbox due to seal failure is not lost and is returned to the compressor or vacuum pump element to there perform its function of lubricating, cooling, sealing and/or corrosion protection of moving parts of the compressor or vacuum pump element again.

In a preferred embodiment of the compressor or vacuum pump device according to the invention, the second inlet is in fluid connection with the gearbox by means of a suction line, wherein the suction line is preferably made of a transparent material.

In such a transparent suction line, a presence of liquid, and consequently the failure of the seals in the compressor or vacuum pump device and a corresponding accumulation of liquid in the gearbox, can easily be detected visually.

In a more preferred embodiment of the compressor or vacuum pump device according to the invention, the suction line is provided with a sensor configured to detect the presence of liquid in the suction line.

Using a sensor, the presence of liquid in the suction line can be evaluated and detected in a systematic and objective way based on a predefined criterion, i.e. a subjective evaluation of the presence of liquid in the suction line by a human observer can be avoided by using the sensor.

Preferably, the sensor is an optical sensor, as this type of sensor is simple and compact in structure, such that the sensor can be easily integrated into the suction line, and because an optical sensor is excellently suitable for detecting any presence of liquid in the suction line.

In an even more preferred embodiment of the compressor or vacuum pump device according to the invention, the sensor is provided with a transmitter that is configured to send a signal that can be picked up by a receiver.

This way, the presence of liquid in the suction line and the failure of the seals in the compressor or vacuum pump device that underlies it can be monitored by the receiver in such a way that the receiver can be warned about a possible seal failure.

Preferably, the signal is sent by the transmitter as a wireless signal so that, if there is a considerable distance between the transmitter and the receiver, a long transmission line to transmit the signal between the transmitter and the receiver can be avoided.

In a subsequent preferred embodiment of the compressor or vacuum pump device according to the invention, the liquid return system further includes a relief valve integrated on the main body.

If a pressure in the main body of the liquid return system exceeds a predefined limit, fluid can be vented via the relief valve.

By integrating the relief valve on the main body, these two components of the liquid return system also form a continuous compact unit without the need for an additional intermediate line with connections along which fluid may leak.

As a result, the functions performed by these two components in the liquid return system are also located in a limited space, which may facilitate assembly, maintenance and/or repair of components in the liquid return system.

In a subsequent preferred embodiment of the compressor or vacuum pump device according to the invention, the liquid return system further comprises a control unit integrated on the main body, which control unit is configured to control a flow rate of the third fluid flow.

Since the outlet of the chamber of the main body of the liquid return system is configured so that it can be in fluid connection with an injection point of the liquid-injected compressor or vacuum pump element, the flow rate of the third fluid flow injected back into the compressor or vacuum pump element via the liquid return system can be controlled by the aforementioned control unit.

By integrating the control unit on the main body, these two components of the liquid return system form a compact whole. As a result, the functionalities performed by these two components in the liquid return system are located in a limited space, which may facilitate assembly, maintenance and/or repair of components in the liquid return system.

In a subsequent preferred embodiment of the compressor or vacuum pump device according to the invention, the liquid return system further comprises an underpressure generating means, which underpressure generating means generates an underpressure in the gearbox.

"Underpressure" in this context means a pressure lower than the pressure of the fluid compressed by the compressor or vacuum pump device at the outlet of the compressor or vacuum pump element.

Using the underpressure generated in the gearbox by the underpressure generating means, liquid which enters the gearbox due to seal failure can be sucked into the main body and into the chamber of the liquid return system, possibly in the opposite direction to counteracting driving forces which could carry the liquid from the main body to the gearbox. An example of these counteracting driving forces may be gravity when the main body of the liquid return system is positioned at a higher level than the gearbox of the compressor or vacuum pump device.

Preferably, the underpressure generating means is provided in the main body of the liquid return system, preferably as a venturi ejector.

By integrating the underpressure generating means in the main body of the liquid return system, it is ensured that the liquid return system can be implemented in a compact and modular manner.

Venturi ejectors are simple and compact in design, as they do not comprise any moving parts to create the underpressure.

In a preferred embodiment of the compressor or vacuum pump device according to the invention, the first inlet of the chamber of the main body of the liquid return system is via a throttling means in fluid connection with the liquid separator vessel.

By means of this throttling means, a flow rate from the first compressed gas flow coming from the liquid separator vessel to the first inlet of the chamber of the main body of the liquid return system can be determined and/or controlled.

The invention also relates to a liquid return system for a compressor or vacuum pump device with a liquid-injected compressor or vacuum pump element, which compressor or vacuum pump device further comprises a motor to drive the liquid-injected compressor or vacuum pump element, a gearbox provided between the motor and the liquid-injected compressor or vacuum pump element, and a liquid separator vessel in fluid connection with an outlet of the liquid-injected compressor or vacuum pump element, wherein the liquid return system comprises a main body with a chamber provided with an outlet and a first inlet, wherein the first inlet is configured to be in fluid connection with the liquid separator vessel and to receive a first compressed gas flow, and wherein the outlet is configured to be in fluid connection with an injection point of the liquid-injected compressor or vacuum pump element, characterized in that the chamber is further provided with a second inlet that is configured to be in fluid connection with the gearbox and to receive a second fluid flow, wherein the chamber is configured to mix the aforementioned first compressed gas flow and second fluid flow together into a third fluid flow, which third fluid flow leaves the chamber via the outlet, and that the liquid return system further comprises a control unit integrated on the main body which control unit is configured to control a flow rate of the third fluid flow.

Obviously, such a liquid return system offers the same advantages as the aforementioned compressor or vacuum pump device according to the invention.

In a preferred embodiment of the liquid return system according to the invention, the liquid return system is designed as a modular element with regard to the compressor or vacuum pump device in such a way that the liquid return system can be detachably be brought in fluid connection with the compressor or vacuum pump device in such a way that, after detaching from the liquid return system, the compressor or vacuum pump device can continue to function under normal operating conditions.

"Normal operating conditions" in this context means that there is no failure of the seals of the compressor or vacuum pump device.

The advantage of designing the liquid return system in such a manner as a modular element is that it can as it were be connected to the compressor or vacuum pump device as a plug-and-play element, so that the liquid return system can easily be detached from the compressor or vacuum pump device, for instance for maintenance and/or replacement, without having to shut down the compressor or vacuum pump device.

Finally, the invention also refers to a method for draining liquid from a gearbox of a compressor or vacuum pump device with a liquid-injected compressor or vacuum pump element, wherein the compressor or vacuum pump device further includes a motor to drive the liquid-injected compressor or vacuum pump element and a liquid separator vessel in fluid connection with an outlet of the liquid-injected compressor or vacuum pump element, wherein the gearbox is provided between the motor and the liquid-injected compressor or vacuum pump element, characterized in that the liquid is removed from the gearbox by means of a liquid return system via a fluid connection between this liquid return system and the gearbox and mixed with a fluid flow from the liquid separator vessel, after which the liquid mixed with this fluid flow is directed into the liquid-injected compressor or vacuum pump element.

Obviously, such a method for draining liquid from a gearbox of a compressor or vacuum pump device with a liquid-injected compressor or vacuum pump element offers analogous advantages to the advantages of the aforementioned compressor or vacuum pump device and liquid return system according to the invention.

BRIEF DESCRIPTION OF THE DRAWINGS

With the intention of better demonstrating the characteristics of the invention, as an example without any restrictive character, a preferred embodiment of the compressor or vacuum pump device according to the invention and of the liquid return system for such a compressor or vacuum pump device are described below, with reference to the drawings, wherein.

DETAILED DESCRIPTION OF THE INVENTION

Figure 1:
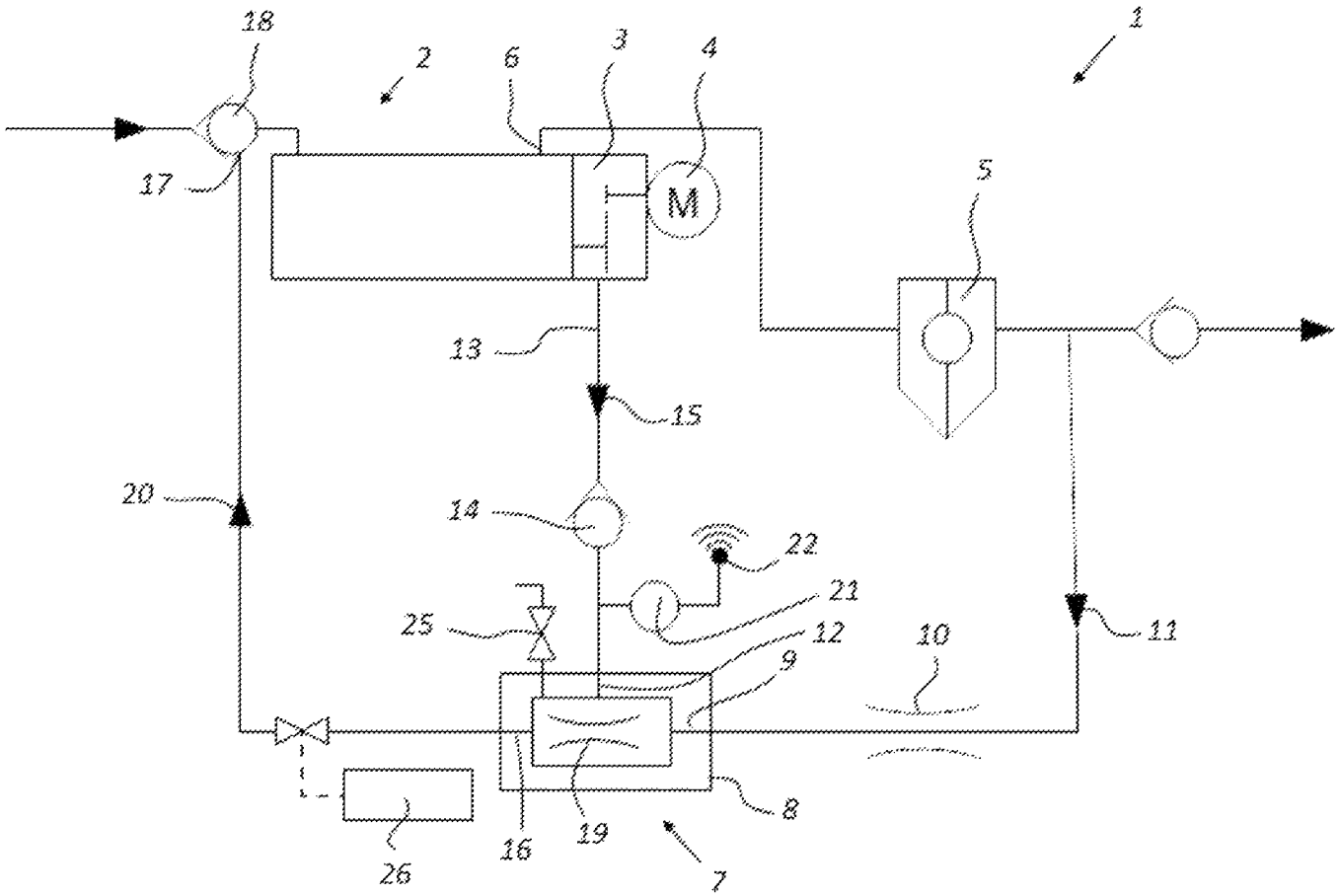
FIG. 1 shows a compressor or vacuum pump device with a liquid-injected compressor or vacuum pump element according to the invention.

FIG. 1 shows a compressor or vacuum pump device 1 according to the invention with a liquid-injected compressor or vacuum pump element 2.

The compressor or vacuum pump element 2 is driven by a motor 4 via a transmission in a gearbox 3.

The compressor or vacuum pump device 1 further comprises a liquid separator vessel 5 which is in fluid connection with an outlet 6 of the liquid-injected compressor or vacuum pump element 2.

In addition, the compressor or vacuum pump device 1 comprises a liquid return system 7 which comprises a main body 8.

A first inlet 9 of the main body 8 of the liquid return system 7 is in fluid connection with the liquid separator vessel 5, preferably via a throttling means 10, and receives a first compressed gas flow 11 coming from this liquid separator vessel 5.

By means of the throttling means 10, a flow rate of the first compressed gas flow 11 coming from the liquid separator vessel 5 to the main body 8 can be regulated.

A second inlet 12 of the main body 8 of the liquid return system 7 is also in fluid connection with the gearbox 3 via a suction line 13, preferably via a non-return valve 14, such that a second fluid flow 15 can only pass through the suction line 13 from gearbox 3 to the liquid return system 7.

Furthermore, an outlet 16 of the main body 8 of the liquid return system 7 is in fluid connection with an injection point 17 of the compressor or vacuum pump element 2.

This injection point 17 is typically located in the inlet valve 18 of the compressor or vacuum pump element 2.

The main body 8 includes an underpressure generating means 19 which is configured to generate an underpressure in the gearbox 3 through which the second fluid flow 15 is sucked in from the gearbox 3.

In the main body 8, the first compressed gas flow 11 and the second fluid flow 15 are mixed into a third fluid flow 20 which is sent via outlet 16 to injection point 17 of the compressor or vacuum pump element 2.

This way, liquid which enters the gearbox 3 due to failure of seals in the compressor or vacuum pump device 1 is sucked out of the gearbox 3 and recovered to the compressor or vacuum pump element 2.

The suction line 13 is provided with a sensor 21, preferably an optical sensor, which is configured to detect a presence of liquid in the suction line 13 and, consequently, seal failure.

Sensor 21 is provided with a transmitter 22 configured to send a wireless signal that can be received by an external receiver.

This external receiver may be, for example, a computer or smartphone which can be used to remotely follow up on and/or control operational conditions of the compressor or vacuum pump device 1.

In addition to a sensor 21 for detecting the presence of liquid in the suction line 13, it is of course not ruled out that the suction line 13 may be provided with additional sensors, for instance to analyze degradation of liquid that may be present in the suction line 13, which may indicate the need to replace and/or regenerate this liquid in the compressor or vacuum pump installation 1.

Figure 2:
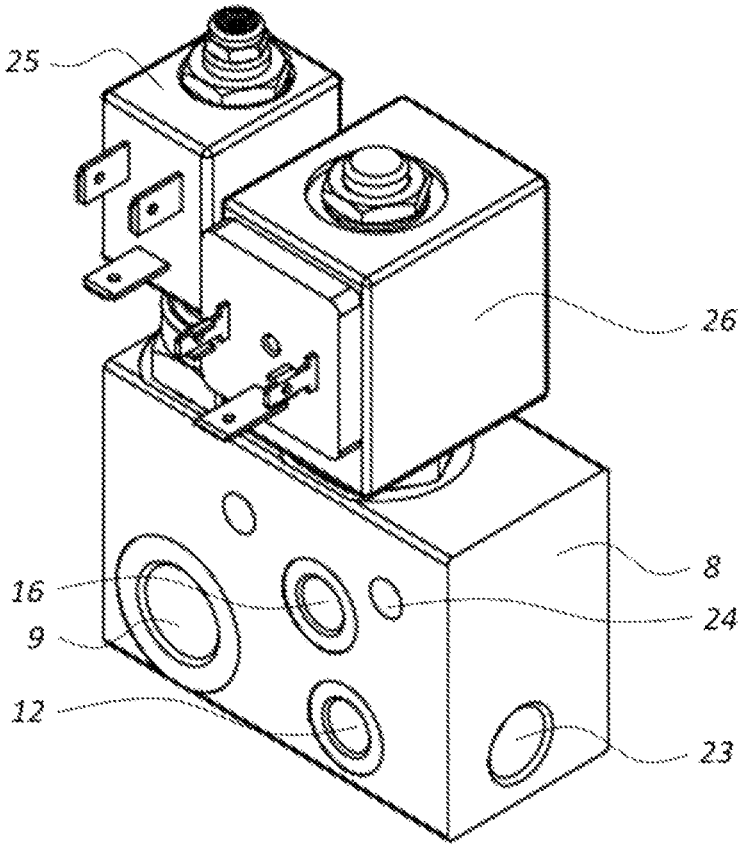
FIG. 2 shows an isometric view of a liquid return system according to the invention.

FIG. 2 shows the main body 8 of the liquid return system 7 according to the invention in more detail.

The main body 8 includes a chamber provided with the outlet 16 for the third fluid flow 20, the first inlet 9 for the first compressed gas flow 11 and the second inlet 12 for the second fluid flow 15.

More specifically, the first inlet 9 is configured to be in fluid connection with the liquid separator vessel 5 and to receive the first compressed gas flow 11, the second inlet 12 to be in fluid connection with the gearbox 3 and to receive the second fluid flow 15, and the outlet 16 to be in fluid connection with an injection point 17 of the liquid-injected compressor or vacuum pump element 2 and to lead the third fluid flow 20 out of the chamber.

The main body 8 may be provided with an additional outlet 23, which additional outlet 23 may then be in fluid connection with the compressor or vacuum pump element 2 at a position downstream of the inlet valve 18.

The main body 8 may also be provided with one or more boreholes 24, which ensure that the main body 8 can be attached to a component of the compressor or vacuum pump device 1, for instance by means of a bolted connection.

A relief valve 25 may be integrated on the main body 8. If a pressure of the first compressed gas flow 11 coming from the liquid separator vessel 5 exceeds a predefined limit value, this first compressed gas flow 11, possibly mixed with the second fluid flow 15 coming from the gearbox 3, may be blown off via the relief valve 25.

In addition, a control unit 26 may be integrated on the main body 8. By means of this control unit 26, a flow rate of the third fluid flow 20, which is fed via outlet 16 to the injection point 17 of the liquid-injected compressor or vacuum pump element 2, can be controlled.

The invention is by no means limited to the embodiments described as examples and shown in the figures, but a compressor or vacuum pump device and a liquid return system for such a compressor or vacuum pump device can be realized in all forms, dimensions and versions without exceeding the scope of protection of the invention as defined in the claims.

The invention claimed is:

1. A compressor or vacuum pump device with a liquid-injected compressor or vacuum pump element (2), which compressor or vacuum pump device (1) further comprises a liquid return system (7), a motor (4) to drive the liquid-injected compressor or vacuum pump element (2), a gearbox (3) provided between the motor (4) and the liquid-injected compressor or vacuum pump element (2), and a liquid separator vessel (5) in fluid connection with an outlet (6) of the liquid-injected compressor or vacuum pump element (2), wherein the liquid return system (7) comprises a main body (8) with a chamber provided with an outlet (16) and a first inlet (9), wherein the first inlet (9) is in fluid connection with the liquid separator vessel (5) and receives a first compressed gas flow (11) from the liquid separator vessel (5), and wherein the outlet (16) is in fluid connection with an injection point (17) of the liquid-injected compressor or vacuum pump element (2), wherein the chamber is also provided with a second inlet (12) which is in fluid connection with the gearbox (3) and receives a second fluid flow (15) from the gearbox (3), and wherein the chamber is configured to mix the aforementioned first compressed gas flow (11) and a second fluid flow (15) together into a third fluid flow (20), which third fluid flow (20) leaves the chamber via the outlet (16) and is directed via the injection point (17) into the liquid-injected compressor or vacuum pump element (2).

2. The compressor or vacuum pump device according to claim 1, wherein the second inlet (12) is in fluid connection with the gearbox (3) by means of a suction line (13).

3. The compressor or vacuum pump device according to claim 2, wherein the suction line (13) is made of a transparent material.

4. The compressor or vacuum pump device according to claim 2, wherein the suction line (13) is provided with a sensor (21) which is configured to detect a presence of liquid in the suction line (13).

5. The compressor or vacuum pump device according to claim 4, wherein the sensor (21) is an optical sensor.

6. The compressor or vacuum pump device according to claim 4, wherein the sensor (21) is provided with a transmitter (22) that is configured to send a signal that can be received by a receiver.

7. The compressor or vacuum pump device according to claim 6, wherein the signal is a wireless signal.

8. The compressor or vacuum pump device according to claim 1, wherein the liquid-injected compressor or vacuum pump element (2) is an oil-injected compressor or vacuum pump element.

9. The compressor or vacuum pump device according to claim 1, wherein the liquid-injected compressor or vacuum pump element (2) is a water-injected compressor or vacuum pump element.

10. The compressor or vacuum pump device according to claim 1, wherein the liquid return system (7) further comprises a relief valve (25) integrated on the main body (8).

11. The compressor or vacuum pump device according to claim 1, wherein the liquid return system (7) is configured to control a flow rate of the third fluid flow (20).

12. The compressor or vacuum pump device according to claim 1, wherein the liquid return system (7) further comprises an underpressure generating means (19), which underpressure generating means (19) generates an underpressure in the gearbox (3).

13. The compressor or vacuum pump device according to claim 12, wherein the underpressure generating means (19) is provided in the main body (8) of the liquid return system (7) as a venturi ejector.

14. The compressor or vacuum pump device according to claim 1, wherein the second inlet (12) is in fluid connection with the gearbox (3) via a non-return valve (14), which non-return valve (14) allows only a fluid flow from the gearbox (3) to the liquid return system (7).

15. The liquid return system for the compressor or the vacuum pumping device according to claim 1, which compressor or vacuum pump device (1) further comprises the motor (4) to drive the liquid-injected compressor or vacuum pump element (2), the gearbox (3) provided between the motor (4) and the liquid-injected compressor or vacuum pump element (2), and the liquid separator vessel (5) in fluid connection with the outlet (6) of the liquid-injected compressor or vacuum pump element (2), wherein the liquid return system (7) comprises the main body (8) with the chamber provided with the outlet (16) and the first inlet (9), wherein the first inlet (9) is configured to be in fluid connection with the liquid separator vessel (5) and to receive the first compressed gas flow (11), and wherein the outlet (16) is configured to be in fluid connection with the injection point (17) of the liquid-injected compressor or vacuum pump element (2), wherein the chamber is further provided with the second inlet (12) which is configured to be in fluid connection with the gearbox (3) and to receive the second fluid flow (15), wherein the chamber is configured to mix the aforementioned first compressed gas flow (11) and second fluid flow (15) together into the third fluid flow (20), which third fluid flow (20) leaves the chamber via the outlet (16), and wherein the liquid return system (7) is configured to control a flow rate of the third fluid flow (20).

16. The liquid return system according to claim 15, wherein it further comprises a relief valve (25) integrated on the main body (8).

17. The liquid return system according to claim 15, wherein it further comprises an underpressure generating means (19) provided in the main body (8), which underpressure generating means (19) is configured to generate an underpressure in the gearbox (3).

18. The liquid return system according to claim 17, wherein underpressure generating means (19) is a venturi ejector.

19. The liquid return system according to claim 18, wherein it is designed as a modular element in relation to the compressor or vacuum pump device (1) in such a way that the liquid return system (7) can be detachably arranged in fluid connection with the compressor or vacuum pumping device (1) and that after detaching the liquid return system (7) the compressor or vacuum pump device (1) can continue to function under normal operating conditions.

20. A method for draining liquid from a gearbox (3) of a compressor or vacuum pump device (1) with a liquid-injected compressor or vacuum pump element (2), wherein the compressor or vacuum pump device (1) further comprises a motor (4) for driving the liquid-injected compressor or vacuum pump element (2) and a liquid separator vessel (5) in fluid connection with an outlet (6) of the liquid-injected compressor or vacuum pump element (2), wherein the gearbox (3) is provided between the motor (4) and the liquid-injected compressor or vacuum pump element (2), wherein by means of a liquid return system (7) liquid is removed from the gearbox (3) by a fluid connection between said liquid return system (7) and the gearbox (3), and mixed with a liquid flow from the liquid separator vessel (5), after which the liquid mixed with this fluid flow is directed into the liquid-injected compressor or vacuum pump element (2).

21. The method according to claim 20, wherein an underpressure generating means (19) is used to generate an underpressure in the gearbox (3).

22. The method according to claim 20 wherein a presence of liquid in the fluid connection between the liquid return system (7) and the gearbox (3) can be detected by means of a sensor (21).

23. The method according to claim 22, wherein the presence of liquid in the fluid connection between the liquid return system (7) and the gearbox (3) is detected by an optical sensor.

24. The method according to claim 22, wherein the sensor (21) sends a signal via a transmitter (22) with information about the aforementioned presence of liquid in the fluid connection between the liquid return system (7) and the gearbox (3), which signal can be received by a receiver.

25. The method according to claim 24, wherein the signal is a wireless signal.

* * * * *